US009689393B2

(12) United States Patent
Fournier et al.

(10) Patent No.: US 9,689,393 B2
(45) Date of Patent: Jun. 27, 2017

(54) MECHANICAL COOLANT PUMP

(75) Inventors: Arnaud Fournier, Yutz (FR); Gilles Simon, Montois la Montagne (FR); Pascal Georges, Thionville (FR); Laurent Finidori, Bertrange (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 351 days.

(21) Appl. No.: 14/373,632

(22) PCT Filed: Feb. 14, 2012

(86) PCT No.: PCT/EP2012/052525

§ 371 (c)(1),
(2), (4) Date: Jul. 22, 2014

(87) PCT Pub. No.: WO2013/120514

PCT Pub. Date: Aug. 22, 2013

(65) Prior Publication Data

US 2015/0016966 A1 Jan. 15, 2015

(51) Int. Cl.
*F04D 1/04* (2006.01)
*F04D 1/00* (2006.01)
(Continued)

(52) U.S. Cl.
CPC ..... *F04D 1/04* (2013.01); *F01P 5/10* (2013.01); *F01P 7/16* (2013.01); *F01P 11/00* (2013.01);
(Continued)

(58) Field of Classification Search
CPC ..... F04D 1/00; F04D 1/04; F04D 15/0005; F04D 15/0022; F04D 29/46;
(Continued)

(56) References Cited

U.S. PATENT DOCUMENTS 4,709,666 A 12/1987 Merz
4,863,144 A 9/1989 Wilson et al.
(Continued)

FOREIGN PATENT DOCUMENTS

CN 102022174 A 4/2011
EP 2 299 084 A1 3/2011
(Continued)

*Primary Examiner* — Craig Kim
*Assistant Examiner* — Brian P Wolcott
(74) *Attorney, Agent, or Firm* — Norman B. Thot

(57) ABSTRACT

A coolant pump includes an outlet volute comprising a pivot axis, an impeller pump, a housing, and an outlet valve arrangement. The housing comprises an outlet volute housing defining the outlet volute and comprises a volute housing wall comprising a recess, and a first outlet channel comprising a valve opening. The outlet valve arrangement is disposed in the first outlet channel and comprises a valve body which opens or closes the valve opening. The valve body comprises a circle segment body comprising a proximal surface and a maximum outside radius. The circle segment body is rotated around the pivot axis. The proximal surface is distant from the pivot axis by an offset distance which is at least ¼ of the maximum outside radius. The recess houses the circle segment body in the closed valve position. A lateral distance of the pivot axis to the volute housing wall is approximately equal to the offset distance.

11 Claims, 5 Drawing Sheets

(51) Int. Cl.

| | |
|---|---|
| ***F04D 15/00*** | (2006.01) |
| ***F01P 11/00*** | (2006.01) |
| ***F01P 5/10*** | (2006.01) |
| ***F01P 7/16*** | (2006.01) |

(52) U.S. Cl.
CPC ..... *F04D 1/00* (2013.01); *F04D 15/0005* (2013.01); *F04D 15/0022* (2013.01)

(58) Field of Classification Search
CPC ..... F04D 29/466; F04D 29/468; F01P 5/10; F01P 7/16; F01P 11/00; F01P 2007/146
USPC ..... 137/625.29, 625.46, 625.47
See application file for complete search history.

(56) References Cited

U.S. PATENT DOCUMENTS

| | | | | |
|---|---|---|---|---|
| 5,095,855 | A | 3/1992 | Fukuda et al. | |
| 2002/0179165 | A1 | 12/2002 | Hu et al. | |
| 2007/0235679 | A1* | 10/2007 | Sutliff | F16K 1/2007 251/317.01 |
| 2009/0183697 | A1 | 7/2009 | Inui | |
| 2012/0076637 | A1 | 3/2012 | Hoji | |
| 2012/0192816 | A1 | 8/2012 | Simon et al. | |
| 2013/0011250 | A1 | 1/2013 | Fournier et al. | |

FOREIGN PATENT DOCUMENTS

| | | | | |
|---|---|---|---|---|
| FR | 2 719 100 | A1 | 10/1995 | |
| JP | 48-104103 | A | 2/1972 | |
| JP | 58-81273 | A | 5/1983 | |
| JP | 61-52469 | A | 3/1986 | |
| JP | 3-222814 | A | 10/1991 | |
| JP | 4-237898 | A | 8/1992 | |
| JP | 10-77837 | A | 3/1998 | |
| JP | 11-2126 | A | 1/1999 | |
| JP | 2005-54997 | A | 3/2005 | |
| JP | 2007-303435 | A | 11/2007 | |
| JP | 2011-7055 | A | 1/2011 | |
| WO | WO 2010/146609 | A1 | 12/2010 | |
| WO | WO 2010/150379 | A1 | 12/2010 | |
| WO | WO 2011/095907 | A1 | 8/2011 | |
| WO | WO 2011/101019 | A1 | 8/2011 | |
| WO | WO 2011095907 | A1 * | 8/2011 | F01P 5/12 |
| WO | WO 2011/154852 | A1 | 12/2011 | |

* cited by examiner

MECHANICAL COOLANT PUMP

CROSS REFERENCE TO PRIOR APPLICATIONS

This application is a U.S. National Phase application under 35 U.S.C. §371 of International Application No. PCT/EP2012/052525, filed on Feb. 14, 2012. The International Application was published in English on Aug. 22, 2013 as WO 2013/120514 A1 under PCT Article 21(2).

FIELD

The present invention relates to a mechanical coolant pump for an internal combustion engine. A mechanical coolant pump is driven by the combustion engine, for example, by using a driving belt driving a driving wheel of the pump, so that the rotational speed of the coolant pump is proportional with the rotational speed of the combustion engine. Only a minimum coolant flow is needed as long as the combustion engine is cold. Mechanical coolant pumps are therefore provided with an outlet valve arrangement to control the coolant flow leaving the coolant pump. As long as the combustion engine is cold, the outlet valve is closed so that the circulation of the lubricant is reduced, minimized or completely stopped, with the result that the combustion engine warm-up phase is shortened.

BACKGROUND

WO 20011/101019 A1 describes a impeller-type coolant pump with an outlet valve arrangement in the root of an outlet channel. The output valve arrangement is provided with a valve flap, whereby the pivot axis of the valve flap is arranged at one end of the flap body and is provided in the surface plane of the outlet channel. The valve flap must be pivotable even at high rotational speeds of the pump rotor at which a high fluid pressure against the valve flap either in closing direction or in opening direction can occur. High actuation power is, however, needed to provide full functionality at all rotational speeds.

SUMMARY

An aspect of the present invention is to provide a mechanical coolant pump for an internal combustion engine with an outlet valve arrangement which is reliably switchable under all circumstances with relatively low actuation forces.

In an embodiment, the present invention provides a mechanical coolant pump for an internal combustion engine which includes an outlet volute comprising a valve body pivot axis, an impeller pump wheel configured to pump an incoming liquid coolant in an axial direction radially into the outlet volute, a pump housing, and an outlet valve arrangement. The pump housing comprises an outlet volute housing which defines the outlet volute and comprises a volute housing wall comprising a recess, and a first outlet channel comprising a valve opening. The outlet valve arrangement is disposed in the first outlet channel. The outlet valve arrangement comprises a valve body configured to be movable between an open valve position and a closed valve position so as to open or close the valve opening of the first outlet channel. The valve body comprises a circle segment body comprising a proximal surface and a maximum outside radius. The circle segment body is configured to be rotated around the valve body pivot axis arranged within the outlet volute. The proximal surface of the circle segment body is distant from the valve body pivot axis by an offset distance which is at least ¼ of the maximum outside radius of the circle segment body. The recess is configured to house the circle segment body in the closed valve position. A lateral distance of the valve body pivot axis to the volute housing wall is approximately equal to the offset distance.

BRIEF DESCRIPTION OF THE DRAWINGS

The present invention is described in greater detail below on the basis of embodiments and of the drawings in which.

DETAILED DESCRIPTION

Figure 1:
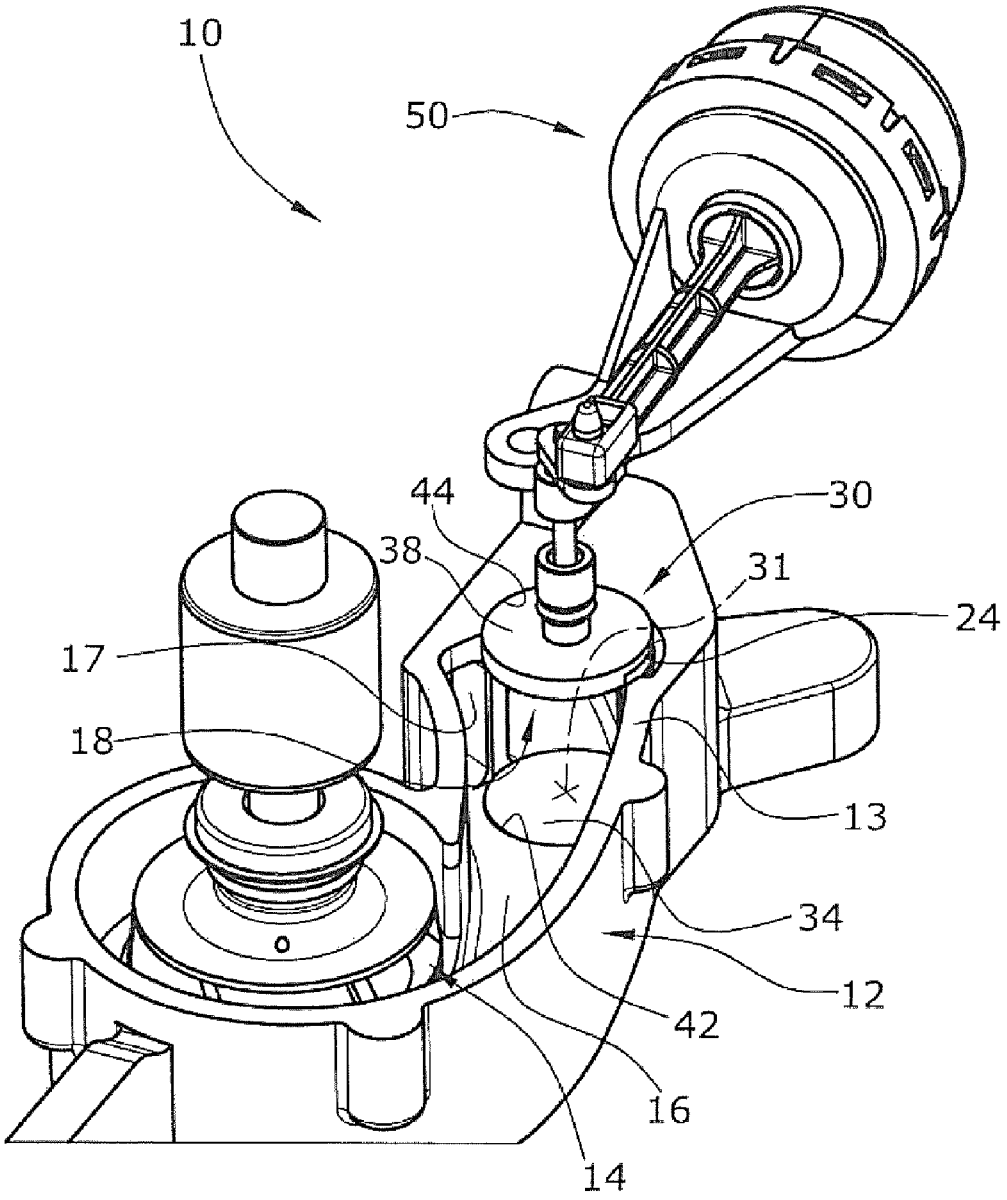
FIG. 1 shows a perspective view of a mechanical coolant pump without a housing cover with a valve body in the open position.

In an embodiment of the present invention, the mechanical coolant pump is provided with an impeller pump wheel pumping the liquid coolant incoming in an axial direction radially outwardly into an outlet volute. The outlet volute continues into a first outlet channel of the pump. An outlet valve arrangement is provided in the course of the first outlet channel, whereby the outlet valve arrangement comprises a valve body being movable between an open position and a closed position to open or to close the valve opening of the first outlet channel.

The valve body is provided with a circle segment body which is rotatable around a valve body pivot axis being provided within the outlet volute so that the valve body pivot axis does not lie in the surface plane of the outlet channel, but in the outlet channel or in the outlet volute itself. The circle segment body is a strip-like body at the circumference of a cylinder. The circle segment body does not need to be provided with a strictly circular distal surface or a strictly plane proximal surface. The proximal surface of the circle segment body is distant from the pivot axis with an offset distance of minimally one fourth of the maximum outside radius of the circle segment with respect to the pivot axis. In other words, the pivot axis does not lie in the plane of the circle segment body. The proximal segment body surface is the surface which is facing the outlet volute or the first outlet channel in the open valve position. The distal segment body surface is the surface which does not face the outlet volute or the first outlet channel in the open valve position.

The volute housing is provided with a recess for housing the circle segment body in the open valve position. The lateral distance of the pivot axis to the volute housing wall comprising the recess for the circle segment body is approximately equal to the offset distance. In the open valve position, the circle segment body is substantially housed in the recess so that the circle segment body does not project substantially into the outlet volute or the outlet channel. The flow resistance caused by the valve body, and, in particular, by the circle segment body in the open valve position is therefore reduced to a minimum. Since the pivot axis is provided with a significant lateral offset distance to the proximal surface of the circle segment body, the pivot axis is within the projection of a mid-section of the circle segment body. The static coolant pressure therefore acts symmetrically against the circle segment valve body with respect to the pivot axis so that the actuation forces for reliably opening and closing the valve body are relatively low.

In an embodiment of the present invention, the proximal surface of the circle segment body can, for example, extend the volute housing wall surface or the first channel wall surface continuously in the open position of the valve body. This means that in the open state of the valve body, the proximal segment body surface continues the surface of the volute or the outlet channel smoothly and steplessly so that the flow resistance is close to zero.

In an embodiment of the present invention, the valve body can, for example, be provided with a circular disk body at one axial end of the circle segment body. The circle segment body can, for example, be provided with a circular disk body at both respective axial ends of the circle segment body. The circular disk body surface plane is orientated substantially perpendicular to the general plane of the circle segment body. The volute housing can, for example, be provided with a circular recess for housing the circular valve disk body. The circular recess corresponds to the circular valve disk body so that the surface of the circular disk body extends the surface of the volute housing continuously in every pivotal position of the valve body. The circular disk body can be mechanically supported by the circular housing recess so that the valve body is well-supported against higher dynamic and static pressure forces generated by the liquid coolant acting against the circle segment body. The circle segment body cannot therefore be tilted so that jamming of the valve body can be reliably avoided and relatively low actuation forces are sufficient for opening or closing the valve body even at high rotational speeds of the pump wheel.

In an embodiment of the present invention, the valve body can, for example, be made of out of metal and is at least partially coated with a rubber coating. The rubber coating of the valve body improves the sealing of the closed valve body. The rubber coating can, for example, be provided at the distal side of the circle segment body.

The proximal side of the valve segment body can, for example, face the pump wheel and the distal side of the valve segment body can, for example, face the pump outlet in the closed position of the valve body.

In an embodiment of the present invention, the outlet volute housing can, for example, define a second outlet channel which is not effected by the outlet valve arrangement and always remains open so that a minimum coolant flow is always provided as long as the pump wheel is driven by the internal combustion engine. Internal combustion engines with a high performance, for example, truck engines, in particular always require cooling with a minimum coolant flow rate to avoid heat pockets. The second outlet channel can alternatively or additionally serve to continuously provide a constant coolant flow for a exhaust gas recirculation or a turbocharger.

In an embodiment of the present invention, the valve body can, for example, be actuated by a pneumatic, an electric or a thermostatic actuator. The needed actuation force for providing a reliable function is relatively low irrespective of how the actuator is constructed.

In an embodiment of the present invention, the valve body and/or the actuator can, for example, be pre-loaded by a mechanical bias spring into the open position so as to provide a fail-safe operation of the coolant pump. The valve body thereby opens or remains open if the actuator fails so that a maximum cooling performance is provided.

The present invention is described below under reference to the drawings.

The FIGS. 1 to 6 show a mechanical coolant pump 10 for circulating a coolant for an internal combustion engine. The coolant pump 10 can be directly mounted to an engine block of the internal combustion engine. The coolant pump 10 is provided with a driving wheel (not shown) which can be driven by a driving belt which is directly driven by the internal combustion engine. The rotational speed of the coolant pump 10 is proportional to the rotational speed of the internal combustion engine.

The coolant pump 10 is provided with a pump housing 12 housing an impeller pump wheel 14 pumping a liquid coolant incoming in axial direction radially into an outlet volute 16. The outlet volute 16 is defined by a volute housing 13 which is a part of the pump housing 12. The axial coolant pump inlet is provided at the bottom side of the coolant pump 10 shown in FIGS. 1 and 2.

Figure 2:
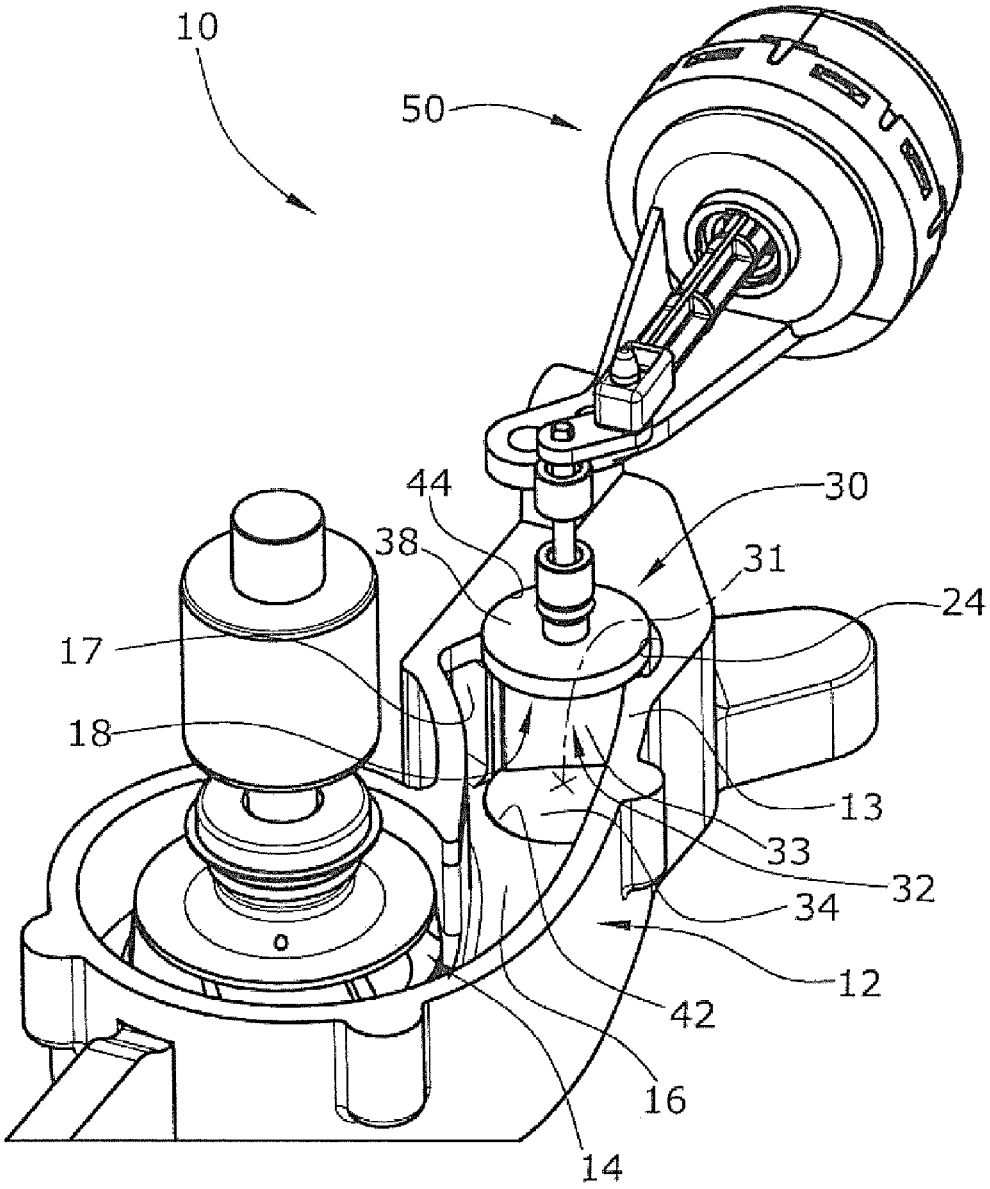
FIG. 2 shows the coolant pump of FIG. 1 with the valve body in the closed position.
Figure 3:
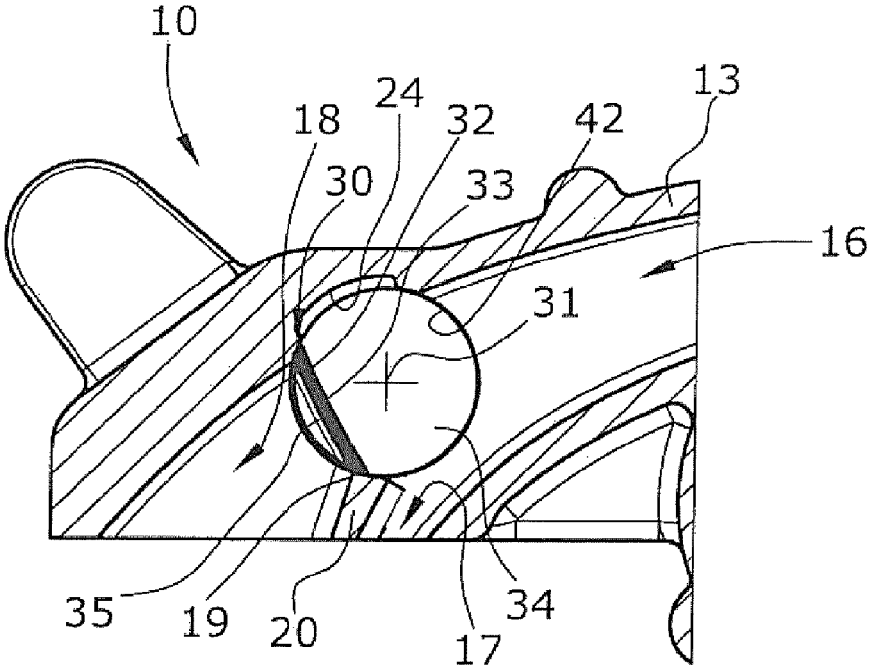
FIG. 3 shows a cross section of the valve arrangement of the coolant pump of FIG. 1 with the valve body in the closed position.

The outlet volute 16 includes a first outlet channel 18 and a second outlet channel 17 which is separated by a separating wall 20 from the first outlet channel 18. The coolant pump 10 is provided with an outlet valve arrangement at a valve opening 19 at the beginning of the first outlet channel 18. The outlet valve arrangement is provided with an integral metal valve body 30 which is pivotable between a closed position and an open position as shown in FIGS. 1 and 2 or in FIGS. 3 and 4. The valve body 30 closes or opens the valve opening 19 of the first outlet channel 18 but does not effect the coolant flow into and through the second outlet channel 17.

Figure 4:
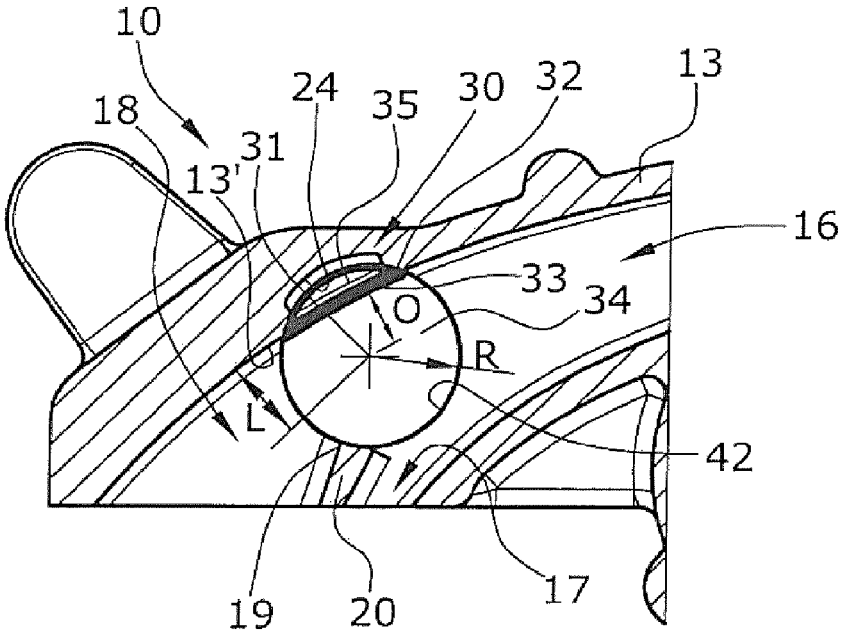
FIG. 4 shows a cross-section of the valve arrangement of the coolant pump of FIG. 1 with the valve body in the open position.

The valve body 30 is provided with a circle segment body 32 with an axial orientation of its general plane. The circle segment body 32 has a proximal surface 33 and a distal surface 35. As shown in FIG. 4, the offset distance O of the maximum outside radius R of the circle segment body 32 with respect to the pivot axis 31 is about ½. The lateral distance L of the pivot axis 31 to the volute housing wall 13' adjacent to the housing recess 24 is approximately equal to the offset distance O. The circle segment body 32 is, somehow, a circumferential section of a hollow cylinder wall.

The circle segment body 32 is axially arranged between a first circular disk body 34 and an identical second circular disk body 38 at both axial ends of the circle segment body 32. The valve body 30 is supported in pivot bearings at both axial ends, so that the valve body 30 is pivotable around an axial valve body pivot axis 31 which is arranged within the outlet volute 16 and defines the middle points of the circular disk bodies 34, 38.

In the open position of the valve body 30, as shown in FIGS. 1 and 4, the circle segment body 32 is housed in a housing recess 24 of the volute housing 13 so that the proximal surface 33 of the circle segment body 32 continues or extends the inside wall surface of the volute housing 13 continuously and without any relevant mechanic steps. As a result, the flow resistance caused by the circle segment body 32 in the open position is not relevant even at high coolant flow rates. In the open position of the valve body 30, as shown in FIG. 4, the proximal side 33 of the circle segment body 32 is orientated to the outlet volute 16, whereas the distal side 35 of the circle segment body 32 is orientated to the housing recess 24 recessing the circle segment body 32.

The first and the second circular disk body 34, 38 are both completely recessed in respective circular housing recesses 42, 44 of the volute housing 13. As a consequence, both circular disk bodies 34, 38 do not cause any relevant flow resistance even at high coolant flow rates, independent of the valve position.

The distal side 35 of the circle segment body 32 is provided with a rubber coating 40 in the circle segment margin zone so that a rectangular rubber bead figure is realized. The rectangular rubber coating 40 improves significantly the sealing quality of the circle segment body 32 in the closed valve position, as shown in FIG. 5.

Figure 5:
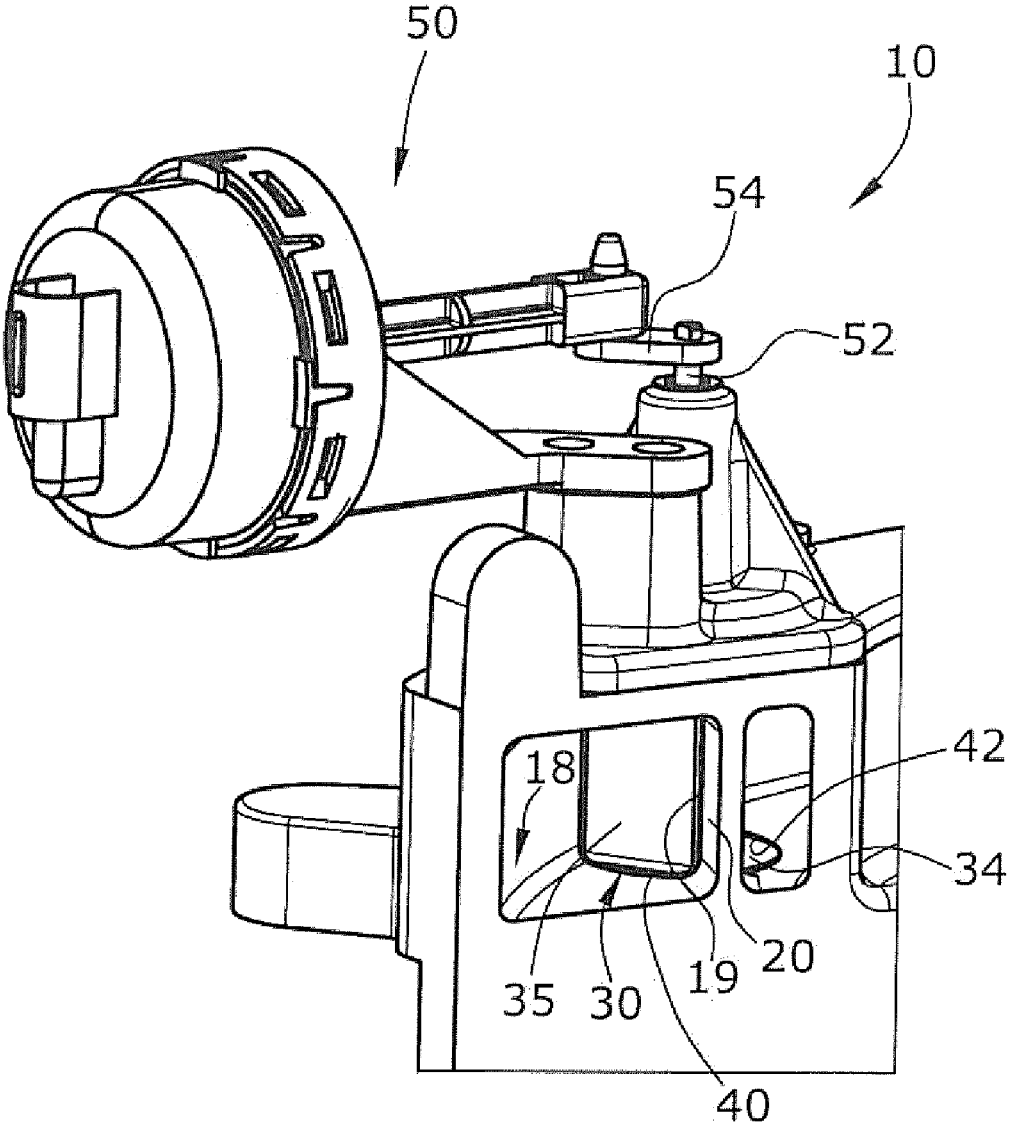
FIG. 5 shows another perspective view of the mechanical coolant pump of FIG. 1 with the valve body in the closed position.
Figure 6:
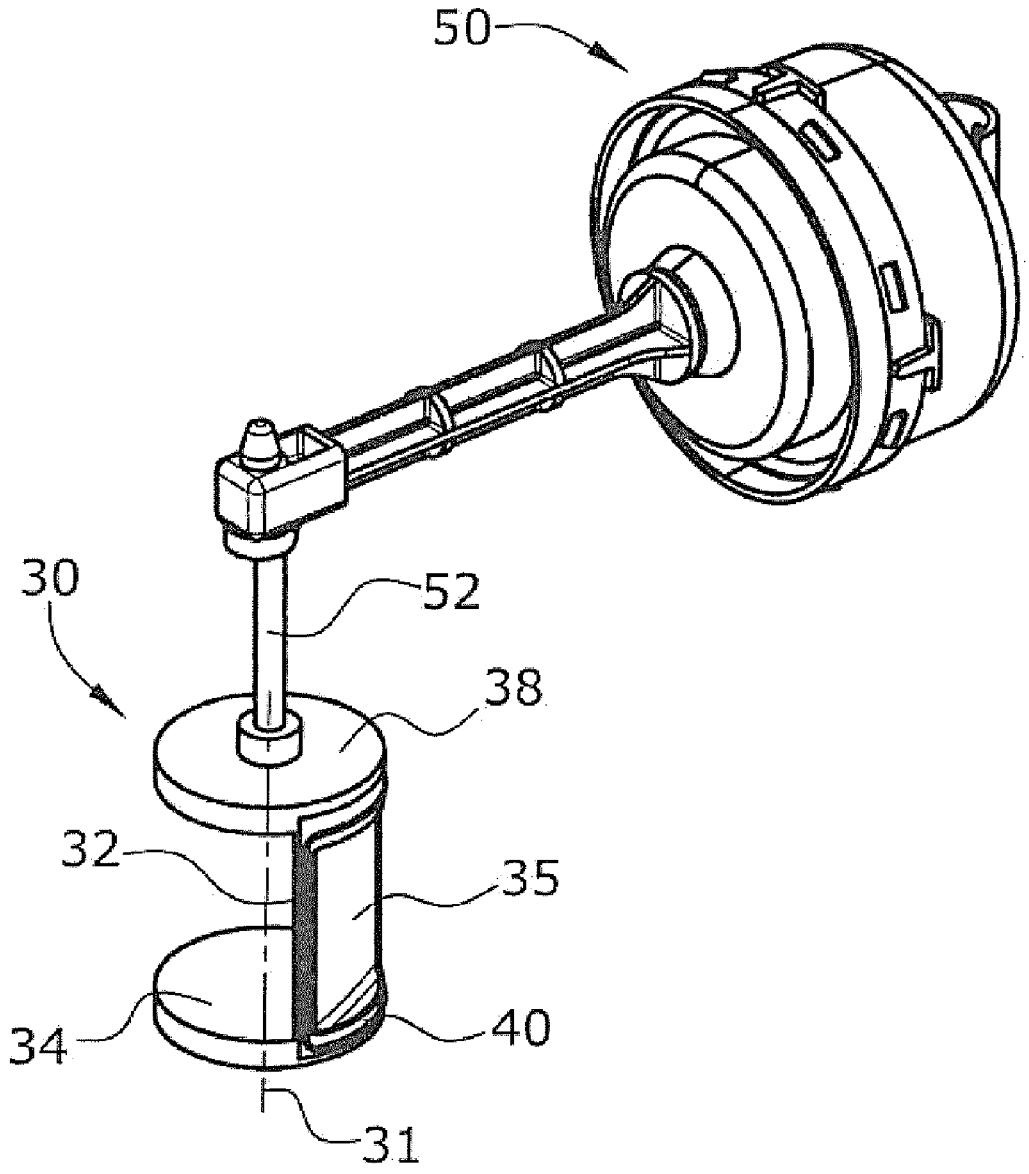
FIG. 6 shows the valve body including an actuator of the mechanical coolant pump of FIG. 1.

The valve body 30 is provided with a valve body shaft 52 with a lever arm 54 which is actuated by a pneumatic actuator 50, as can be seen in FIGS. 5 and 6.

The present invention is not limited to embodiments described herein; reference should be had to the appended claims.

What is claimed is:

1. A mechanical coolant pump for an internal combustion engine, the mechanical coolant pump comprising:

an outlet volute comprising a valve body pivot axis;

an impeller pump wheel configured to pump an incoming liquid coolant in an axial direction radially into the outlet volute;

a pump housing comprising an outlet volute housing which defines the outlet volute and comprises a volute housing wall comprising a recess, and a first outlet channel comprising a valve opening; and an outlet valve arrangement disposed in the first outlet channel, the outlet valve arrangement comprising a valve body configured to be movable between an open valve position and a closed valve position so as to open or close the valve opening of the first outlet channel, the valve body comprising a circle segment body comprising a proximal surface and a maximum outside radius, the circle segment body being configured to be rotated around the valve body pivot axis arranged within the outlet volute, wherein, the proximal surface of the circle segment body is distant from the valve body pivot axis by an offset distance which is at least ¼ of the maximum outside radius of the circle segment body, the recess is configured to house the circle segment body in the open valve position, and a lateral distance of the valve body pivot axis to the volute housing wall is substantially equal to the offset distance.

2. The mechanical coolant pump as recited in claim 1, wherein the proximal surface of the circle segment body is configured to extend the outlet volute housing so as to be continuous when the valve body is in the open valve position.

3. The mechanical coolant pump as recited in claim 1, wherein the circle segment body comprises a top axial end and a bottom axial end, the top axial end is arranged opposite to the bottom axial end, and the valve body further comprises a first circular disk body which is arranged at the bottom axial end of the circle segment body so as to co-rotate therewith.

4. The mechanical coolant pump as recited in claim 3, wherein the valve body further comprises a second circular disk body which is arranged at the top axial end of the circle segment body so as to co-rotate therewith.

5. The mechanical coolant pump as recited in claim 4, wherein the outlet volute housing further comprises a circular recess configured to house the first circular disk body and the second circular disk body.

6. The mechanical coolant pump as recited in claim 1, wherein the proximal surface of the circle segment body is configured to extend the outlet volute housing continuously in every position of the valve body.

7. The mechanical coolant pump as recited in claim 1, wherein the valve body comprises metal and is at least partially coated with a rubber coating.

8. The mechanical coolant pump as recited in claim 7, wherein the circle segment body further comprises a distal side, and the rubber coating is provided at the distal side of the circle segment body.

9. The mechanical coolant pump as recited in claim 1, wherein the outlet volute housing further defines a second outlet channel which is configured so as not to be influenced by the outlet valve arrangement.

10. The mechanical coolant pump as recited in claim 1, further comprising an actuator configured to actuate the valve body.

11. The mechanical coolant pump as recited in claim 10, wherein the actuator is a pneumatic actuator, an electric actuator, or a thermostatic actuator.

* * * * *